United States Patent [19]

Reed et al.

[11] 4,025,282

[45] May 24, 1977

[54] APPARATUS TO BURN LIQUID FUELS IN A GASEOUS FUEL BURNER

[75] Inventors: Robert D. Reed; Hershel Goodnight, both of Tulsa, Okla.

[73] Assignee: John Zink Company, Tulsa, Okla.

[22] Filed: May 21, 1975

[21] Appl. No.: 579,466

[52] U.S. Cl. ..... 431/11; 431/3; 431/4; 431/190; 431/210; 431/281; 431/284

[51] Int. Cl.[2] ..... F23D 11/44

[58] Field of Search ..... 431/11, 210, 278, 279, 431/281, 284, 285, DIG. 21, DIG. 22, 4, 190, 3

[56] References Cited

UNITED STATES PATENTS

| | | | |
|---|---|---|---|
| 1,481,764 | 1/1924 | Weaver | 431/DIG. 21 |
| 1,587,798 | 6/1926 | Owen | 431/278 |
| 1,976,528 | 10/1934 | Vandeveer | 431/4 |
| 2,489,823 | 11/1949 | Senninger | 431/DIG. 22 |
| 2,975,594 | 3/1961 | Eastman | 431/4 X |
| 3,672,808 | 6/1972 | Miyazaki | 431/190 X |

*Primary Examiner*—Edward G. Favors
*Attorney, Agent, or Firm*—Head, Johnson & Chafin

[57] ABSTRACT

Apparatus to burn liquid fuels in a gaseous fuel burner, which includes preparatory apparatus for the atomization of liquid fuel oil preferably by steam, and the heating of the fuel droplets and steam so as to completely vaporize the liquid fuel. If atomization is by other means, steam is added prior to vaporization heating. The resulting oil vapor-steam mixture then goes to a burner which utilizes the central orifice of a conventional gas burner, plus an annular orifice concentric with the gas orifice, through which steam is supplied. Primary air is induced into the burner tube due to the high velocity jets of steam and of oil vapor-steam. The steam protects the hot vapor from the air until the combination issues from the end of the burner tube. For the use of gaseous fuel, the same burner is utilized except that the steam flow is turned off since the steam is not needed for the induction of the primary air, due to the higher velocity of the jets of gas.

3 Claims, 5 Drawing Figures

APPARATUS TO BURN LIQUID FUELS IN A GASEOUS FUEL BURNER

BACKGROUND OF THE INVENTION

This invention lies in the field of fuel burning for heat supply. More particularly, it concerns the design of a burner and fuel system which can be used either with gaseous or liquid fuels.

Because of the restricted supplies of gaseous fuels which are typically in the natural gas category, it is at times necessary to burn liquid fuels as replacements for the normally used gaseous fuels, where fuel burning is required in the operation of industries, generally, but particularly, in the chemical and petroleum industries, where all functions of production result from the application of heat in some manner.

Such application of heat is typically carried out in process heaters of many shapes and forms, in which the delicacy and intimate control with which heat is applied, is at times quite critical. Gaseous fuels lend themselves well to critical firing. Thus, heaters are typically and preferentially gas fired. In view of increasing gas fuel shortage, this leads to problems of fuels firing which are serious, because of the quite different characteristics of gas firing versus liquid fuel firing.

Many process heaters built during the time of ample gaseous fuel supplies are equipped with burners for gaseous fuel firing only. Alternative firing with typical liquid fuels, demand burners which are of the combination gas and oil type, which are well-known in the industry. Such alteration in fuel firing capability requires removal of the gas-only burners and replacement of them with combination gas-and-oil burners. This expedient is expensive and, due to time for burner change, it results in intolerable loss of critical product production.

SUMMARY OF THE INVENTION

It is a primary object of this invention to provide a fuel burning system in which either gas or liquid fuels can be burned alternately, without any change in equipment.

It is a further object of this invention to provide a liquid fuel burning system in which the liquid is fully vaporized prior to entering the burner so that the burning characteristic of the vaporized liquid fuel is substantially the same as that of gaseous fuels.

These and other objects are realized and the limitations of the prior art are overcome in this invention which will permit alternative burning of either gaseous or liquid fuels in the same burner without necessity for burner change, and has the further advantage of provision of burning conditions for either gaseous or liquid fuels which are essentially identical in burning characteristics, rather than quite different, as would be the case with combination gas and liquid fuel burners.

The burner is substantially similar to a gas fuel burner in that it has a central conduit and orifice through which gaseous or vaporized fuel is supplied. It is modified, however, in that it has an annular passage surrounding the central gas and vapor passage, through which steam is supplied. The steam issues through an annular orifice in a continuous cylindrical curtain or barrier, around the vapor flow. If gaseous fuel is used, it is supplied directly to the central conduit of the burner through appropriate controls, and the steam flow is cut off since it is unnecessary.

If liquid fuel is to be used, the liquid is atomized, into very small particles of liquid which have a high surface-to-mass ratio, and can be easily vaporized in a heater, through which the droplets-steam mixture flows. In the heater all of the liquid droplets are vaporized and a flow of oil vapor and steam then proceeds to the burner, and enters through the central passage where gas would normally be flowed. Additional steam is used, and flows through the annular orifice surrounding the central orifice, through which is vapor-steam mixture flows. The additional steam flow is required because of its energy to induce sufficient primary air. A second reason for the steam flow is to protect the flow of oil vapor which is now at a substantial temperature, as the result of the heating in the heater, and the vapor is protected from contact with air by a screen of steam until the fuel, steam and air mix in the burner tube, and are ignited at the outflow end of the burner tube.

BRIEF DESCRIPTION OF THE DRAWINGS

These and other objects and advantages of the invention and a better understanding of the principles and the details of the invention will be evident from the following description taken in conjunction with the appended drawings in which.

DESCRIPTION OF THE PREFERRED EMBODIMENT

Figures 1, 2:
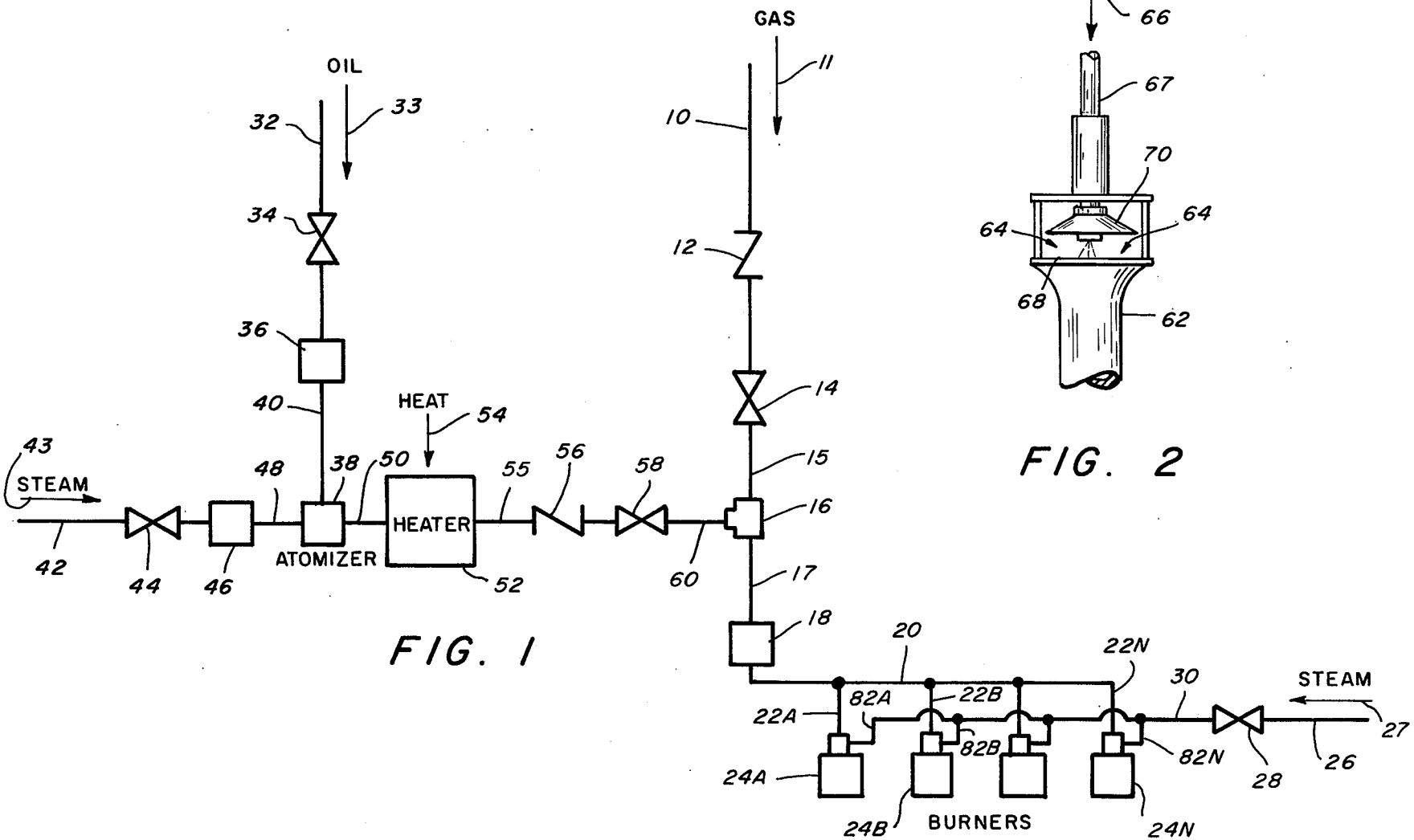
FIG. 1 represents schematically the fuel supply system to a battery of burners, where alternate oil or gas can be supplied as fuel.
FIG. 2 illustrates a conventional gaseous fuel burner.

Referring now to the drawings and in particular to FIG. 1, there is shown in schematic form the flow lines and controls of a combination gaseous and liquid fuel supply and burner system.

A single, or group of burners, 24A, 24B . . . 24N are shown which are to be supplied with gaseous or liquid fuel. If the fuel is gaseous, it would be supplied through a supply line 10 in accordance with arrow 11 to a check valve 12 and through a shut-off valve 14, through conduits 15 and 17, through a control and metering means 18, to a manifold 20 which supplies the gas through lines 22A, 22B . . . 22N.

FIG. 2 shows a conventional gaseous fuel burner in which gas is supplied through a pipe 67, in accordance with arrows 66 and provides a jet of gaseous fuel 68 when it issues from an orifice in the end of the pipe 67. The high velocity of the jet of gas entrains air and provides an induced flow of air in accordance with arrows 64. This is the primary air for combustion and is entrained with the high velocity stream of gas and is turbulently mixed inside of the burner tube 62, from which it issues and is ignited in a conventional manner. The shield 70 is provided so that it can be moved vertically so as to control the area of the opening through which the primary air 64 enters. No extra source of energy is required to provide sufficient primary air, because of the normal high pressure and high velocity of discharge of the gas supplied through the pipe 67.

Figure 3:
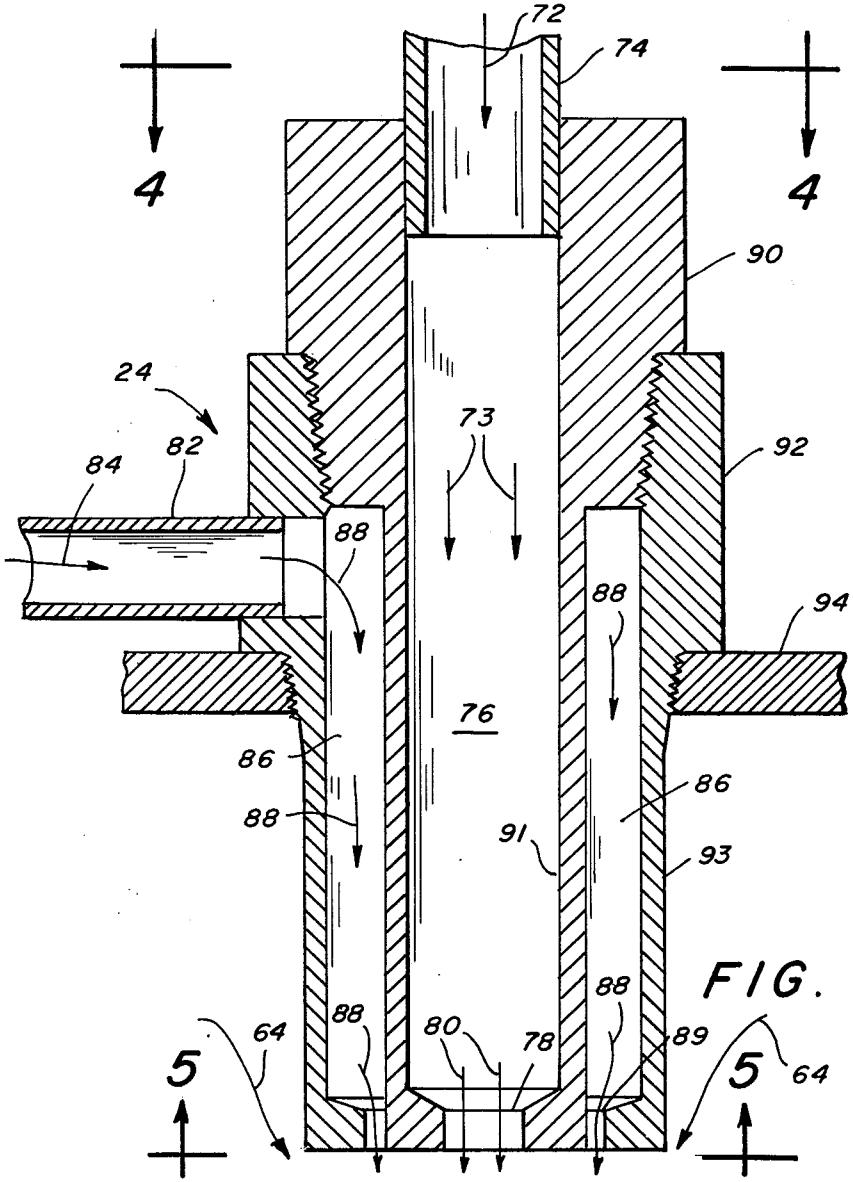

In this system the normal gas burner, as shown in FIG. 2 is modified as shown in FIG. 3, to have not only the central passage 76 through conduit 91 and orifice 78 supplied with gas in accordance with arrows 72, 73 and 80, but it has also an annular passage 86 through conduit 93, which surrounds the conduit 91 and terminates is an annular orifice 89, through which steam is supplied, by means of pipe 82 in accordance with arrows 84, 88. The fuel to be supplied to the burner passage 76 is in the form of an oil vapor which is mixed with steam but will not generally have the high discharge velocity which is characteristic of normal gaseous fuel as supplied. Consequently, steam under suitable pressure is required to provide a high velocity stream of steam, in the form of a cylindrical curtain around the vapor flowing through the orifice 78. This high velocity stream of steam provides the required induction of primary air. And as will be explained further, it serves to isolate the vapor flow 80 from contact with the primary air 64.

Referring back to FIG. 1, there is shown a conduit 32 supplying fuel oil in accordance with arrow 33 and a shut-off valve 34, with some metering device 36, if desired. The oil flow then passes through conduit 40 to an atomizer 38, of conventional form. Steam flows through conduit 42 in accordance with arrow 43, through shut-off valve 44, and metering device 46 to the atomizer through conduit 48. The steam provides the energy to atomize the oil into minute droplets of large area-to-mass ratio. Additionally, the steam serves to preheat the oil for its passage through line 50 to a heater 52, wherein heat is applied in accordance with arrow 54, to the mixture of steam and liquid droplets. The heater can be of any desired form. For example, it can be direct-fired or it can make use of waste-heat or it can use steam as heat sources for vaporization of oil droplets.

The final temperature should be high enough so that all of the liquid droplets will be vaporized. This might be in the neighborhood of 450°. In any case, it is sufficient to vaporize all the liquid, and therefore the line 55 carries a mixture of steam and oil vapor through a check valve 56, and a shut-off valve 58, and through line 60 to a tee 16 whereby the steam-vapor mixture can pass alternately to the gas flow, through the line 17 to the metering device 18 and to the burners 24.

Whenever the oil is being used, the gas flow is completely shut off by the shut-off valve 14. Conversely, when gas is being used the oil is shut off by the valve 34 and the steam is shut off by the valve 44 and the valve 58 is further shut off to avoid leakage of gaseous fuel back into the heater system. Preferably, check valves 56 and 12 are also applied to prevent leakage of either fuel back into the fuel system not in use, in case of failure to obtain complete shut-off by valves 58 and 14.

Each of the burners 24 will be similar to the burner indicated generally by the numeral 24 in FIG. 3. That is, it will provide the central passage for either gas alone, or vapor and steam mixture, flowing down through the central conduit 91 or orifice 78. It also has the annular passage 86 formed between the conduit 91 and an outer conduit 93 providing an annular orifice 89. Steam enters this annular channel through pipe 82 in accordance with the arrow 84 and flows down and around the annular chamber 86 and out through the orifice 89 in accordance with arrows 88.

FIG. 1 shows a separate steam line 26 flowing in accordance with arrows 27 through a valve 28 and to each of the burners 24 by means of line 30 and through lines 82A, 82B, . . . 82N to the burners 24.

Figure 4:
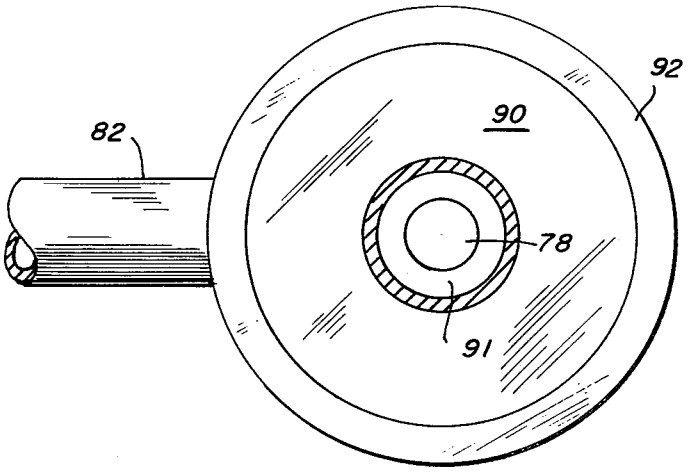
FIGS. 3, 4 and 5 show three views of a combination gas and vapor burner, according to the present invention.
Figure 5:
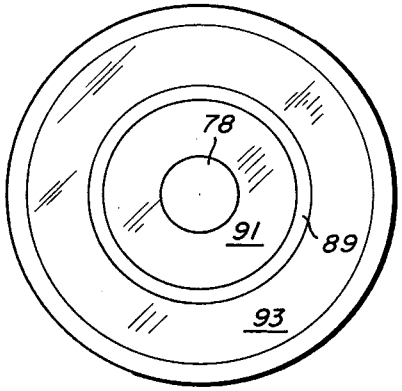

FIGS. 4 and 5 show other views of the burner 24.

FIG. 4 shows a view taken across the plane 4—4 of FIG. 3, while FIG. 5 shows a view of the two orifices of the burner, and is taken across the plane of 5—5 of FIG. 3.

In review, what has been shown is a modified gaseous fuel burner in which gas or oil vapor-steam fuel can be flowed axially through a conduit 91 to an orifice and into a burner tube, such as 62 of FIG. 2. When gas is used alone, that is the entire flow. When liquid is used and has been atomized by steam, and vaporized, and the fuel is in the form of a steam-vapor, the flow follows that of the gas down through the conduit 91 and orifice 78. However, when the steam-vapor is used additional steam must be applied through the pipes 82. This steam issues at high velocity through the annular orifice 89. This high velocity steam serves to induce sufficient primary air 64 for the complete combustion of the fuel.

However, there is a further reason for the steam supply. In the vaporizing process in the heater 52, the temperature of the oil vapor may be above the temperature that it will spontaneously combust when mixed with air. In such a case, without the steam protection in the form of a cylindrical screen, to isolate the hot vapor from the air 64, the vapor would flash into flame immediately after orifice 78, rather than at the outlet of the burner tube 62, and therefore would do great damage to the burner and other apparatus. Consequently, the steam serves the double purpose of inducing air, and protecting the vapor from contact with air until it progresses down the burner tube 62 and issues at the open end of the tube in the furnace, or other chamber, in which the burning takes place.

The use of metering devices 36, 46, and 18 is optional, provided adequate flow control can be provided by means of the shut-off valves 34, 44, 58 and 14, respectively.

Once this system is set up, the fuel going to the burners can be switched rapidly from gas to liquid fuel, and vice-versa.

In fuels burning, some excess air is demanded for complete burning in avoidance of fuel wastage. However, too much excess air results also in fuel wastage and, is to be avoided. Since the kinetic energy for air inspiration with gaseous fuels is greater than that with preheated oil-steam vapor as fuel, steam to supply supplemental energy must be supplied whenever the change of fuel is from gaseous to oil vapor-steam.

No detail is shown of the atomizer 38 since there is no structural limitation. The function of the atomizer, which is typical of all atomizers, is to break up the liquid oil mass into droplets, which are best measured in microns, for great increase of the liquid surface-to-mass ratio. This provides rapid vaporization of the liquid, plus homogeneous mixture of liquid vapor and steam.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. A system for alternative burning of gaseous and liquid fuels, comprising:

a. a dual fuel orifice burner, including:

1. a central orifice for supplying alternatively gaseous fuel or oil vapor-steam mixture for burning in a flame immediately downstream of said dual fuel orifice burner;
2. a coaxial annular orifice and means to selectively supply steam thereto around said flame when said oil vapor-steam mixture is being supplied to said central orifice;

b. conduit and first shut-off means for selectively supplying gaseous fuel to said central orifices of aid burner; and c. conduit and second shut-off means for selectively supplying oil vapor-steam to said central orifice of said burner.

2. In an apparatus for burning gaseous hydrocarbon fuel, the method of burning liquid hydrocarbon fuel, comprising the steps of:

a. atomizing said liquid hydrocarbon fuel into small droplets;

b. mixing said droplets with steam;

c. heating said mixture of liquid droplets plus steam until said droplets vaporize and a mixture of hydrocarbon vapor plus steam is formed; and d. flowing said mixture of hydrocarbon vapor plus steam under pressure through a circular orifice into a burner tube; while e. simultaneously flowing steam through an annular orifice coaxial with said circular orifice.

3. A method of burning liquid fuel in an apparatus equipped with at least one orifice for normally burning gaseous combustible fluids, comprising the steps of:

a. atomizing said liquid fuel into small droplets;

b. mixing said droplets with steam;

c. heating said mixture of liquid droplets plus steam until said droplets vaporize and a mixture of combustible fluid vapor plus steam is formed; and d. flowing said mixture of combustible vapor plus steam under pressure through said at least one orifice into a burner.

* * * * *